United States Patent [19]

Nichols et al.

[11] Patent Number: 4,532,943

[45] Date of Patent: Aug. 6, 1985

[54] ADJUSTABLE FILTER CIGARETTE

[75] Inventors: Walter A. Nichols; Reginald W. Newsome, both of Richmond, Va.

[73] Assignee: Philip Morris Incorporated, New York, N.Y.

[21] Appl. No.: 429,392

[22] Filed: Sep. 30, 1982

[51] Int. Cl.[3] ..... A24D 1/04; A24F 13/04

[52] U.S. Cl. ..... 131/336; 131/335; 131/336; 131/198.1; 131/198.2

[58] Field of Search ..... 131/336, 198 R, 198 A, 131/335

[56] References Cited

U.S. PATENT DOCUMENTS

| | | | |
|---|---|---|---|
| 1,015,723 | 1/1912 | Blackwood | 131/336 |
| 2,269,995 | 1/1942 | Trane | 131/336 |
| 2,693,193 | 11/1954 | Pelletier | 131/336 |
| 2,841,153 | 7/1958 | Pelletier | 131/336 |
| 2,923,647 | 2/1960 | Aghnides | 131/336 |
| 2,936,763 | 5/1960 | Saffir | 131/336 |
| 3,057,360 | 10/1962 | Bugge | 131/336 |
| 3,232,299 | 2/1966 | Miller | 131/336 |
| 3,283,762 | 11/1966 | Kissel | 131/336 |
| 3,327,718 | 6/1967 | Kilburn | 131/336 |
| 3,359,988 | 12/1967 | Thomson | 131/338 |
| 3,376,874 | 4/1968 | Kim et al. | 131/207 |
| 3,428,050 | 2/1969 | Kandel | 131/338 |
| 3,441,028 | 4/1969 | Wall | 131/336 |
| 3,463,166 | 8/1969 | Bennett et al. | 131/336 |
| 3,496,945 | 2/1970 | Tomkin | 131/336 |
| 3,503,406 | 3/1970 | Riegel et al. | 131/338 |
| 3,504,678 | 4/1970 | Pitt | 131/336 |
| 3,512,537 | 5/1970 | Pelletier | 131/336 |
| 3,515,146 | 6/1970 | Nealis | 131/274 |
| 3,519,000 | 7/1970 | Houser | 131/336 |
| 3,596,665 | 8/1971 | Lindgard | 131/336 |
| 3,601,131 | 8/1971 | Reggio | 131/336 |
| 3,608,561 | 9/1971 | Dock | 131/336 |
| 3,664,350 | 5/1972 | Wall | 131/336 |
| 3,685,522 | 8/1972 | Kleinhans | 131/336 |
| 3,695,274 | 10/1972 | Summers | 131/336 |
| 3,713,452 | 1/1973 | D'Elia et al. | 131/336 |
| 3,738,375 | 6/1973 | Doumas | 131/336 |
| 3,759,268 | 9/1973 | Plourde | 131/336 |
| 3,773,053 | 11/1973 | Stephens, Jr. | 131/336 |
| 3,774,622 | 11/1973 | Steigerwald | 131/336 |
| 3,789,855 | 2/1974 | Norman | 131/336 |
| 3,847,161 | 11/1974 | Morgenstern | 131/336 |
| 3,916,914 | 11/1975 | Brooks et al. | 131/336 |
| 4,201,234 | 5/1980 | Neukomm | 131/336 |
| 4,219,030 | 8/1980 | Hall | 131/336 |
| 4,232,574 | 11/1980 | Hall | 131/336 |
| 4,254,782 | 3/1981 | Ligeti | 131/336 |
| 4,340,074 | 7/1982 | Tudor | 131/336 |
| 4,343,319 | 8/1982 | Cantrell | 131/336 |
| 4,362,171 | 12/1982 | Johnson et al. | 131/336 |
| 4,369,796 | 1/1983 | Hall | 131/336 |
| 4,380,241 | 4/1983 | Horsewell | 131/336 |
| 4,433,696 | 2/1984 | Adams | 131/336 |

FOREIGN PATENT DOCUMENTS

| | | | |
|---|---|---|---|
| 901910 | 6/1972 | Canada | 131/336 |
| 913486 | 10/1972 | Canada | 131/336 |
| 706624 | 3/1954 | United Kingdom | 131/336 |
| 1058343 | 2/1967 | United Kingdom | 131/336 |
| 1095848 | 12/1967 | United Kingdom | 131/336 |
| 2099678 | 12/1982 | United Kingdom | 131/336 |

*Primary Examiner*—V. Millin
*Assistant Examiner*—Greg Beaucage
*Attorney, Agent, or Firm*—Jeffrey H. Ingerman

[57] ABSTRACT

A filter cigarette is provided which comprises a tobacco rod which includes a charge of tobacco wrapped in cigarette paper, an integral, axially aligned cylindrical filter plug, and tipping paper. The filter plug is divided into first and second segments with the first segment being rotatable with respect to the second segment. Rotation of the first segment with respect to the second segment, in one embodiment of the invention, serves to vary the air dilution value of the cigarette. In another embodiment, rotation of the first segment with respect to the second segment produces variable resistance-to-draw in the cigarette. Both of the above embodiments can be combined into yet another embodiment to produce a cigarette which maintains a constant resistance-to-draw value as the air dilution value is varied. In yet another embodiment, an encapsulated flavorant is provided which is released responsive to rotation of the first segment with respect to the second segment. The flavorant release embodiment can be combined with the other embodiments.

27 Claims, 15 Drawing Figures

ADJUSTABLE FILTER CIGARETTE

BACKGROUND OF THE INVENTION

The present invention relates to filter cigarettes. More particularly, the present invention relates to filter cigarettes which are adjustable by the smoker to vary one or more of the air dilution value, the resistance-to-draw value, and the flavor of the cigarette.

Various mechanisms have been disclosed in heretofore issued patents which provide for adjustment of the air dilution value of a filter cigarette, but these mechanisms are not without certain advantages. While many complicated mechanisms have been disclosed, the simpler mechanisms generally involved making one or more openings in a substantially air impermeable filter plug wrap and the overlying, substantially air impermeable tipping paper. A sleeve containing one or more corresponding openings is placed over the tipping paper and is then either rotated or moved axially to select the degree to which the two sets of openings are in registry. In another embodiment found in the art, the filter is not glued to the tipping paper and thus may be moved axially within the cylinder formed by the tipping paper. Openings are made in the tipping paper which correspond to openings made in the filter plug wrap. The air dilution value is adjusted by axially moving the filter plug within the tipping paper to adjust the degree to which the two sets of openings are in registry.

Among the problems associated with such mechanisms are that the sleeve or the filter plug may be removed from the cigarette by the smoker and not readily replaced. Also, registry between the two sets of openings may be inadvertently destroyed by a slight axial movement of the sleeve or plug. Accordingly, the air dilution value selected by the smoker is not insured of any degree of consistency. Yet another problem associated with a number of these prior devices is that they have not been readily adaptable to a high rate of production on cigarette making machinery of conventional design.

These prior adjustable cigarettes also do not provide a means to maintain the resistance-to-draw (hereinafter "RTD") value constant as the air dilution value changes, nor are such cigarettes adjustable to vary the RTD value while maintaining a substantially constant air dilution value. Also, these prior adjustable cigarettes do not provide an encapsulated flavorant which is released in varying amounts during adjustment of the air dilution value, the RTD value or both values.

Accordingly, it is an object of the present invention to provide a filter cigarette, which can be readily manufactured on conventional cigarette making equipment, that is adjustable by the smoker to vary one or more of the air dilution value, the RTD value, and the flavor of the cigarette.

SUMMARY OF THE INVENTION

A filter cigarette is provided which comprises a tobacco rod, that is, a charge of tobacco wrapped in cigarette paper, attached to an axially aligned, wrapped cylindrical filter plug, and tipping paper. The filter has a mouth end and a rod end, both of which are open to permit passge of air and smoke, and is divided into first and second segments by a circumferentially extending cut which defines a central, axial core about which the first segment can be rotated relative to the second segment. The tipping paper circumscribes and joins the filter plug to the tobacco rod in abutting end-to-end relation, and extends from substantially the mouth end of the filter plug to a point on the tobacco rod adjacent the rod end of the filter plug.

In variable air dilution embodiments, at least one opening is made through the tipping paper and the underlying portion of the filter plug wrap, such that, as the first segment of the filter is rotated about the axis of the central core, the opening in the tipping paper and the opening in the underlying portion of the filter plug are in varying degrees of registry to permit varying amounts of air to enter the filter and combine with the smoke, thereby varying the air dilution value of the cigarette. The air dilution value is the ratio of the volume of air to the volume of smoke exiting the mouth end of the filter and is expressed as a percentage.

The present invention also includes within its scope a filter cigarette without the variable dilution feature but which has a variable RTD provided by assembling the filter and tipping paper as described above but without the openings therethrough and providing a plurality of longitudinally extending channels in the first segment and a plurality of longitudinally extending channels in the second segment of the filter which are in varying degrees of registry as the first segment is rotated about the axis of the core, thereby providing paths of less resistance for the flow of the smoke through the filter, thus varying the RTD value of the cigarette.

Also included within the scope of the present invention is a filter cigarette having the previously described variable dilution feature as well as the sets of channels of the variable RTD embodiment. As the first segment is rotated about the central core to increase the air dilution value, the RTD decreases. The channels of this embodiment are configured such that, as the air dilution value is decreased by rotation of the first segment, the channels are subject to increasing deregistry which increases the RTD. The net effect of the increased air dilution and deregistry of the channels is to maintain a constant RTD.

Yet another embodiment included within the scope of the present invention is a filter cigarette with or without the variable dilution feature and with or without the variable or constant RTD feature which is provided with an encapsulated flavorant which is released in varying amounts responsive to rotation of the first segment about the longitudinal axis of the core.

The cigarettes of the present invention may be manufactured employing conventional equipment with only minor modifications and a method of manufacturing such cigarettes forms yet another aspect of the present invention.

DESCRIPTION OF THE PREFERRED EMBODIMENTS

The present invention will now be described with reference to the figures in which like elements are given like reference numbers throughout.

Figure 1:
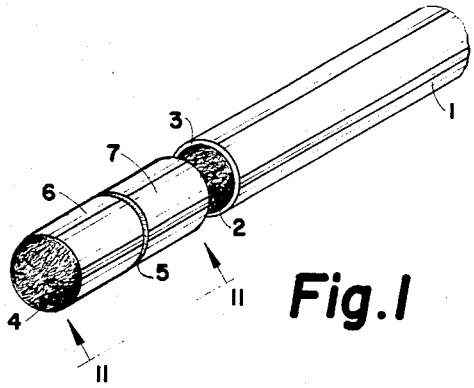
FIG. 1 is an enlarged fragmentary perspective view of the filter plug and tobacco rod of the filter cigarette of the present invention taken from the mouth end.
Figure 2:
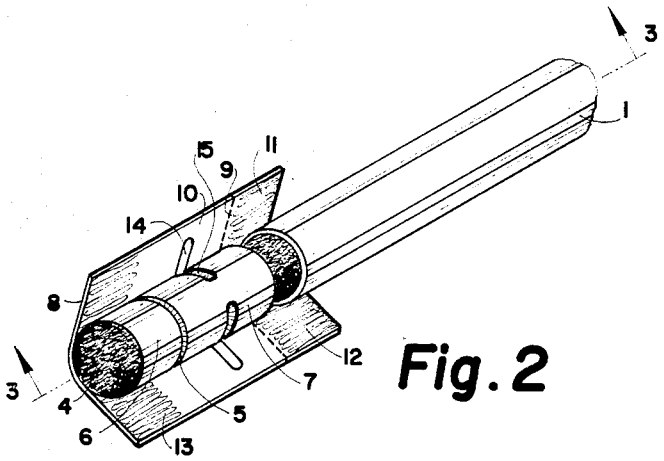
FIG. 2 is a fragmentary perspective view of one embodiment of the filter cigarette of the present invention taken from the mouth end and showing the tobacco rod, filter, and tipping paper as well as the openings provided through the tipping paper and plug wrap to provide for variable dilution.
Figure 3:
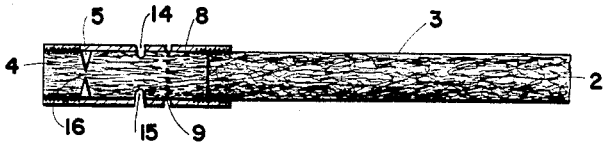
FIG. 3 is longitudinal section taken on the line 3—3 of FIG. 2.
Figure 7:
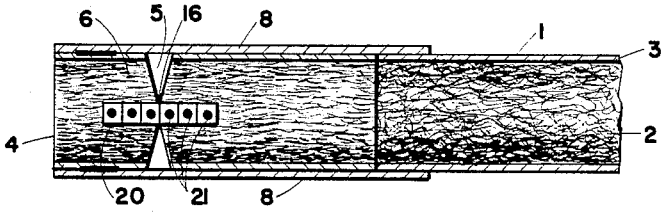
FIG. 7 is a partial cross-sectional view of a fourth embodiment of the invention which provides a variable amount of flavorant.
Figure 11:
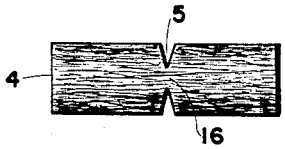
FIG. 11 is a longitudinal section taken on the line 11—11 of FIG. 1.

A preferred embodiment of the variable dilution cigarette of the present invention is shown in FIGS. 1, 2, and 3 and comprises a tobacco rod 1, which is a substantially cylindrical charge of tobacco 2 wrapped in cigarette paper 3. The tobacco rod is joined in abutting end-to-end relation to a wrapped filter plug 4 which has a circumferentially extending cut 5 intermediate the mouth end and the tobacco rod end defining a central axial core 16, as shown in FIGS. 3, 7 and 11, and which divides the filter plug into a first mouth-end segment 6 and a second rod-end segment 7.

The filter plug and a portion of the mouth end of the tobacco rod are circumscribed by non-porous tipping paper 8. The tipping paper has a circumferentially extending row of closely spaced perforations 9 which overlie the second segment 7 of the filter plug adjacent the mouth end of the tobacco rod 1. This row of perforations divides the tipping paper into a first mouth-end band 10 and a second rod-end band 11.

The inner surface of band 10 is attached adjacent the mouth end to the first segment 6 of the filter plug, preferably by means of an adhesive band 13. The inner surface of band 11 joins the second segment 7 of the filter plug to the mouth end of the tobacco rod 1, preferably by means of a band of adhesive 12 extending, in width, between the row of perforations 9 and the rod-end of band 11. At least one opening is made through the tipping paper and the underlying plug wrap at a position on band 10 intermediate the row of perforations 9 and the cut 5.

Since the openings 14 and 15 are formed simultaneously, they are initially in registry and variable dilution is achieved by rotating band 10 and breaking the row of perforations 9, thereby allowing band 10 and the segment 6 to rotate in unison about the central core 16. This core will typically have a diameter within the range of from about 12.7% to about 38.1% of the diameter of the filter plug, a value of about 25.4% being preferable. This range will permit segment 6 to be rotated 360° without breaking the core 16. Rotation of band 10 rotates opening 14 relative to opening 15 thus varying the degree of registry, thereby varying the air dilution value of the cigarette.

Both the tipping paper 8 and the wrapping of the filter plug 4 are substantially air impermeable wrappings which restrict any radial air flow through the filter paper and underlying plug wrap to the area of registry between openings 14 and 15. The filter paper may be any commercially available, substantially air impermeable paper and the filter plug may be any conventional, substantially cylindrical filter such as a cellulose acetate filter or the like. The filter material can be of uniform density or it can contain a substantially cylindrical axial core of relatively high density filter material circumscribed by filter material of relatively lower density. When it is desired to use the non-uniform density filter plug, the higher density filter material preferably forms the previously described axial core 16. Any conventional, substantially air impermeable plug wrap may be employed.

Means for permitting the smoker to select the specific air dilution ratio may be provided through indicia (not shown) printed on opposite sides of the row of perforations 9, and which are made readily visible and designed to show the degree of registry of the openings.

Figure 4:
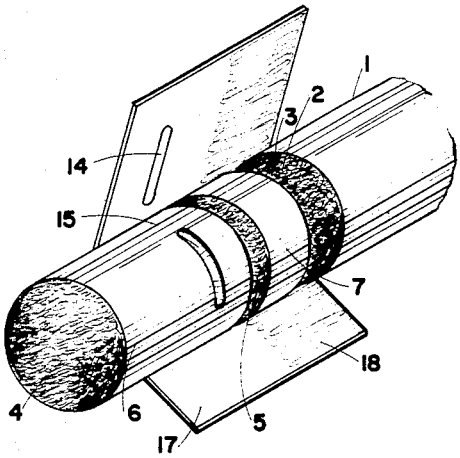
FIG. 4 is a fragmentary perspective view of a second embodiment of the present invention taken from the mouth end.
Figure 5:
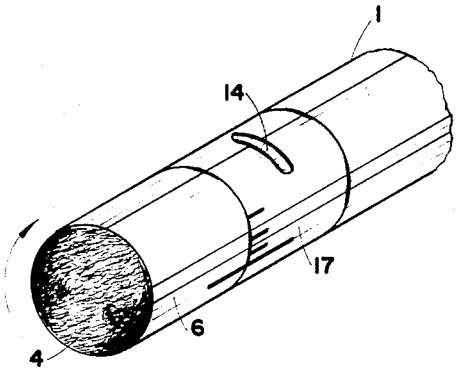
FIG. 5 is a perspective view of the assembled embodiment of FIG. 4.

A second preferred embodiment shown in FIGS. 4 and 5 comprises a tobacco rod 1 containing a charge of tobacco 2 wrapped in cigarette paper 3 and joined to filter plug 4 in abutting, end-to-end relation. The filter plug has a circumferentially extending cut 5 intermediate the mouth end and the tobacco rod end which divides the filter plug into a first mouth-end segment 6 and a second rod-end segment 7. The filter plug is joined to the tobacco rod by tipping paper 17, preferably by a band of adhesive 18 on the inner surface of the tipping paper which overlaps the abutting ends of the filter and the tobacco rod. The tipping paper extends from a position on the tobacco rod adjacent the filter to a point intermediate the cut 5 and the mouth end of segment 6. An opening 14 is made through the tipping paper at a position between the cut 5 and the mouth end of the tipping paper. A corresponding opening 15 is made in the plug wrap at a position underlying opening 14. Openings 14 and 15 are preferably made simultaneously and thus are initially in registry.

Circumferentially extending cut 5 defines a central, axially extending core 16 having a preferred diameter as noted in connection with the first preferred embodiment. In practice, that portion of filter plug segment 6, which is not wrapped by tipping paper 17, is grasped by the smoker and rotated about the central core 16, thus rotating openings 15 relative to openings 14, thereby varying the degree of registry of the two sets of openings and, accordingly, the air dilution value of the cigarette.

Figure 6:
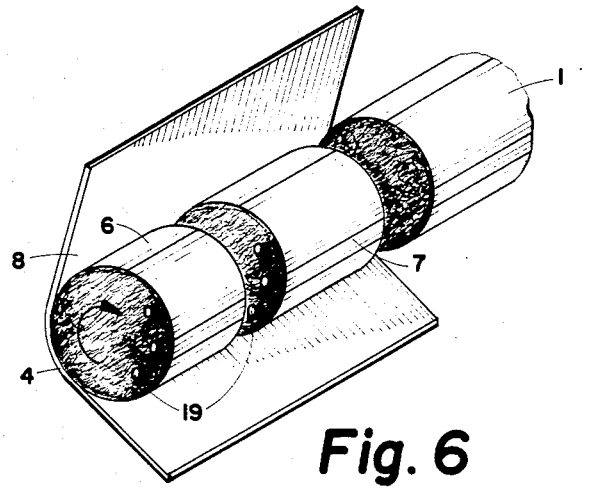
FIG. 6 is a fragmentary perspective view of a third variable RTD embodiment of the cigarette of the present invention.

In a third embodiment of the present invention shown in FIG. 6, the openings 14 and 15 of the first and second embodiment may be omitted or retained and a plurality of axially extending passages 19 made in the first and second segments 6 and 7 of the filter plug. These passages in the first and second segments 6 and 7 are made such that, as the first segment 6 of the filter plug is rotated about the axis of the central core 16, the passages in the first and second segments are in varying degrees of registry thus varying the RTD of the cigarette. Variable RTD may be selected in conjunction with variable dilution such that the RTD is constant as the dilution is varied or may be selected in the absence of variable dilution to provide a variable RTD cigarette.

In a fourth preferred embodiment shown in FIG. 7, a flavor encapsulation means is inserted within the filter. This means may comprise an axially extending cellophane tube 20 containing individual cells 21 of flavorant which are ruptured in response to rotation of the first segment of the filter plug about the central core 16. As can be seen from FIG. 7, increased rotation of the first segment of the filter plug serves to increase the twist experienced by the cellophane tube, thereby rupturing an increasing number of flavorant cells. The smoker can thus vary the intensity of flavor released by the flavor capsule by rotating the filter plug a desired amount. The flavor system of this embodiment may be used in conjunction with any of the embodiments.

Figure 8:
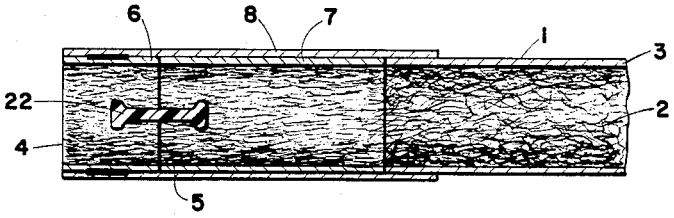
FIG. 8 is a partial cross-sectional view of a fifth embodiment of the invention in which the segments of the filter plug are joined by a plastic extrusion.

FIG. 8 shows an alternative arrangement for maintaining a rotational connection between the first segment 6 and the second segment 7 of the filter plug 4. In this arrangement, plastic extrusion 22, formed as part of the filter plug, lies along the axis of the first and second segments. The cut 5 extends down to this extrusion. It will be appreciated by those of ordinary skill in the art that the plastic extrusion shown in FIG. 8 can be used with any of the first, second or third embodiments.

The cigarettes of the present invention may be readily produced on conventional cigarette making and tipping apparatus with a minimum of modification. Forming and cutting the cigarette rod and filter plug to length are done conventionally. Also, bringing the filter plug into axial alignment with the cigarette rod and the overwrapping with tipping paper are accomplished in the same manner as in the manufacture of conventional cigarettes.

Furthermore, additional simplicity in manufacturing is made possible in the present invention by simultaneously forming the openings in the tipping paper and underlying plug wrap. This is accomplished, in one manner, simply by slitting or perforating the tipping paper and underlying plug wrap on each cigarette as it passes through the conventional cigarette making machinery at or near a rolling shoe station.

Figure 9:
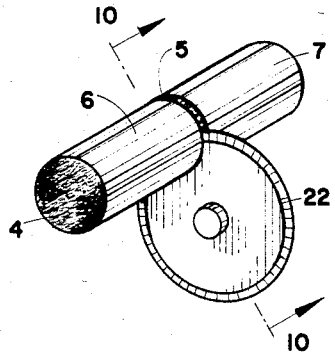
FIG. 9 is a perspective view of a wrapped filter plug of the present invention showing the circular cutting disc forming the circumferentially extending cut in the filter plug.
Figure 10:
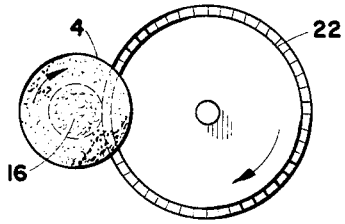
FIG. 10 is a sectional view taken along the line 10—10 of FIG. 9 showing the depth of the cut of the circular blade into the filter plug and the resultant axial core.

As shown in FIGS. 9 and 10, the circumferentially extending cut 5 in the filter plug 4 may be made using a circular knife 38 which is set to penetrate a specified distance into the filter plug, perpendicular to the longitudinal axis of the filter plug. Typically, the circular knife and the filter plug are both rotated as shown in FIG. 7, resulting in a circumferentially extending cut which leaves a central core 16 along the longitudinal axis of the filter plug.

The row of perforations 9 in the tipping paper in the first embodiment may be made by any conventional means such as laser perforation, electrostatic perforation, or mechanical perforation using points or knives. In practice, the tipping paper is fed through a perforation zone where it is exposed to a laser light beam. The power setting and focusing of the laser and the rate of feed of the tipping paper are selected so as to all but part the paper along the "break away" line 9 shown in FIG. 2. The attachment which remains is selected to retain only enough strength to hold the first and second bands of the tipping paper together during assembly. Preferably, a laser system is employed to make about 100 perforations per inch in the paper.

Figure 12:
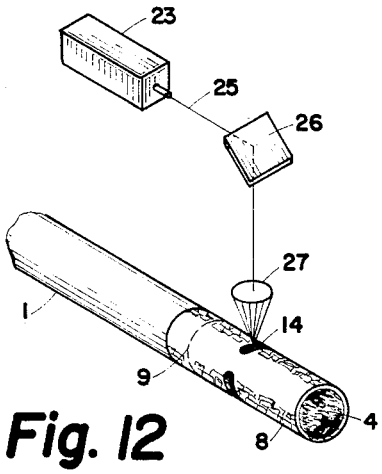
FIG. 12 is a view in perspective of a laser system for use in making the openings in the tipping paper and underlying plug wrap of the variable dilution filter cigarette of the present invention.
Figure 13:
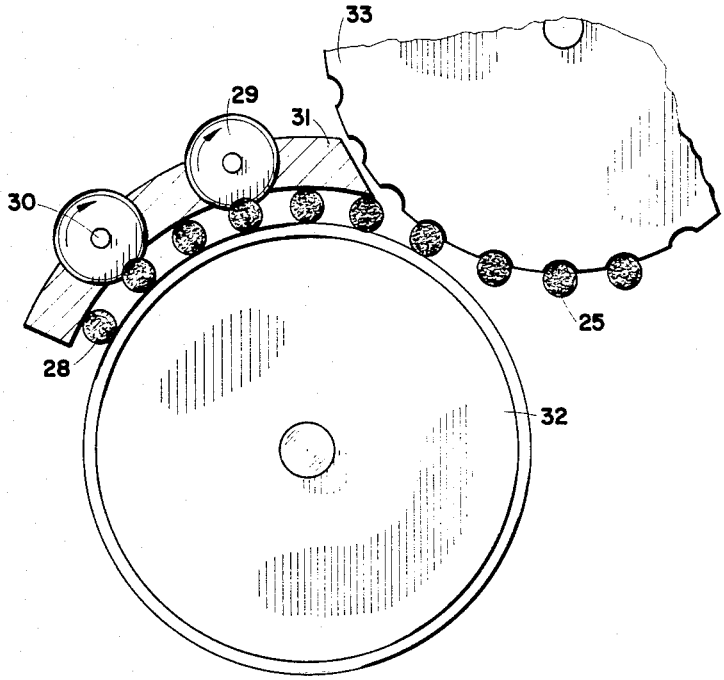
FIG. 13 is a partial elevational view of a mechanical apparatus for use in making openings in the tipping paper and underlying plug wrap of the variable dilution cigarette of the present invention.
Figure 14:
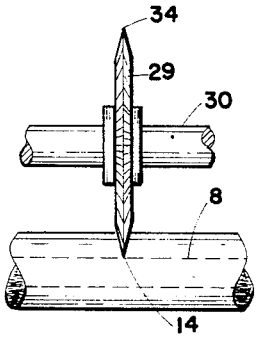
FIG. 14 is a partial elevational view of the cutting mechanism of the apparatus of FIG. 13.
Figure 15:
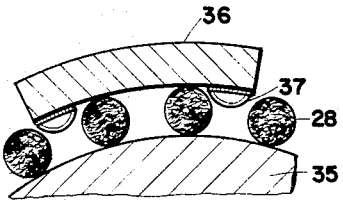
FIG. 15 shows an alternate embodiment of the apparatus of FIG. 13.

The tipping paper may be applied to the filter plug and tobacco rod employing conventional cigarette making equipment and then the openings 14 and 15 are made through the tipping paper and underlying plug wrap employing either a laser system as shown in FIG. 12 or a mechanical system as shown in FIGS. 13, 14 and 15.

Preferably, as shown in FIG. 12, a laser perforation system is employed which uses a laser 23 to generate a laser beam 25 that is reflected by mirror 26 and collected by lens 27 which focuses the beam. Laser beam 25 is focused to traverse the rotating cigarette and is set to remain on for a time period sufficient to make an opening, preferably a slit of a desired length, through the tipping paper and the underlying plug wrap. Slits one millimeter wide are preferred. If it is desired to establish a line of perforations instead of slits, the laser beam may be pulsed.

The opening through the tipping paper and the underlying plug wrap may also be made by mechanical means as shown in FIGS. 13, 14 and 15. As shown in FIG. 13, cigarettes 28 are passed between rotating drums 32 and 33. Drum 32 feeds the cigarettes beneath a fixed plate 31 into contact with a circular knife 29 rotating about shaft 30 and having V-shaped edge 34 as shown in FIG. 14. In an alternate embodiment shown in FIG. 15, the cigarettes 28 are fed between a rotating drum 35 and a fixed plate 36 past semi-circular knife blades 37 which are fixed to the plate 36.

It will be understood that the particular embodiments described above are only illustrative of the principles of the present invention, and that various modifications can be made by those skilled in the art without departing from the scope and spirit of the present invention.

We claim:

1. A filter cigarette comprising a tobacco rod, a substantially cylindrical filter plug, a plug wrapping circumscribing said filter plug, and tipping paper circumscribing and joining said filter plug and a portion of said tobacco rod, at least one of said plug wrapping and said tipping paper being substantially air-impermeable, said filter plug comprising a mouth-end segment of filter tow material axially connected to a rod-end segment of filter tow material for rotation about the axis of the cigarette, the filter tow material of the mouth-end segment being in direct contact with the filter tow material of the rod-end segment.

2. The filter cigarette of claim 1, wherein said mouth-end segment and said rod-end segment are defined by a circumferential cut in said filter plug.

3. A filter cigarette comprising a tobacco rod, a substantially cylindrical filter plug, a plug wrapping circumscribing said filter plug, and tipping paper circumscribing and joining said filter plug and a portion of said tobacco rod, at least one of said plug wrapping and said tipping paper being substantially air-impermeable, said filter plug comprising a mouth-end segment of filter tow material and a rod-end segment of filter tow material, said mouth-end segment and said rod-end segment being defined by a circumferential cut in said filter plug wherein said cut extends partially through said filter plug and defines a central axial core of filter tow material connecting said mouth-end segment to said rod-end segment, said mouth-end segment being axially connected to and in direct contact with said rod-end segment for rotation about the axis of the cigarette.

4. The filter cigarette of claim 2 including an axial plastic extrusion connecting said segments, said cut extending to said extrusion, said extrusion extending into each of said segments of filter tow material.

5. A filter cigarette comprising a tobacco rod, a substantially cylindrical filter plug comprising an inner substantially cylindrical core of filter tow material and an outer substantially cylindrical layer of filter tow material circumscribing said inner filter tow material, wherein the density of said inner filter tow material is greater than the density of said outer filter tow material, a plug wrapping circumscribing said filter plug, and tipping paper circumscribing and joining said filter plug and a portion of said tobacco rod, at least one of said plug wrapping and said tipping paper being substantially air-impermeable, said filter plug comprising a mouth-end segment and a rod-end segment, said mouth-end segment and said rod-end segment being defined by a circumferential cut in said filter plug, said cut extending to the inner filter tow material, said mouth-end segment being axially connected to and in direct contact with said rod-end segment for rotation about the axis of the cigarette.

6. The filter cigarette of any one of claims 1 through 5 further comprising a means for varying the air dilution value of said filter cigarette responsive to rotation of the mouth-end segment with respect to the rod-end segment.

7. The filter cigarette of claim 6 wherein said tipping paper comprises, in sequence, first, second and third bands, said first band fixedly connecting said tobacco rod to said rod segment, said second band containing a first opening, and said third band fixedly connecting said second band to said mouth segment and further wherein the plug wrap overlying said rod segment contains a second opening underlying said first opening so that rotation of the mouth segment with respect to the rod segment varies the registry between the first and second openings.

8. The filter cigarettes of claim 6 wherein said tipping paper comprises, in sequence, first and second bands, said first band fixedly connecting said tobacco rod to said rod-end segment and said second band containing a first opening and further wherein the plug wrap overlying said mouth-end segment contains a second opening underlying said first opening so that rotation of the mouth-end segment with respect to the rod-end segment varies the registry between the first and second openings.

9. The filter cigarette of any one of claims 1 through 5 further comprising a means for varying the resistance-to-draw of said filter cigarette responsive to rotation of the mouth-end segment with respect to the rod-end segment.

10. The filter cigarette of claim 9 wherein said means for varying the resistance-to-draw comprises a first longitudinal bore extending through said mouth-end segment and a second longitudinal bore extending through said rod-end segment, whereby rotation of the mouth-end segment with respect to the rod-end segment varies the registry between the first and second bores.

11. The filter cigarette of claim 6 further comprising a means for varying the resistance-to-draw of said filter cigarette responsive to rotation of the mouth-end segment with respect to the rod-end segment.

12. The filter cigarette of claim 11 wherein the means for varying the resistance-to-draw is adapted to maintain the resistance-to-draw value of said cigarette constant as the air dilution value is varied.

13. The filter cigarette of claim 7 wherein said second band is perforatedly connected to said first band.

14. The filter cigarette of any one of claims 1 through 5 further comprising an encapsulated flavorant disposed within said filter plug and adapted to release varying amounts of flavorant responsive to rotation of the mouth-end segment with respect to the rod-end segment.

15. The filter cigarette of claim 6, further comprising an encapsulated flavorant disposed within said filter plug and adapted to release varying amounts of flavorant responsive to rotation of the mouth-end segment with respect to the rod-end segment.

16. A method of manufacturing the filter cigarette of any of one claims 1 through 4 comprising cutting a tobacco rod and a wrapped filter plug to a desired length, bringing the tobacco rod and the wrapped filter plug into axial alignment, overwrapping the tobacco rod and the wrapped filter plug with tipping paper, forming a circumferential cut in said wrapped filter plug and said tipping paper, said circumferential cut extending partially through said wrapped filter plug and defining first and second segments and a central core along the longitudinal axis of said wrapped filter plug, such that the first segment is rotatable relative to the second segment about the longitudinal axis of the filter plug.

17. A filter plug for use in the formation of a filter cigarette, comprising a substantially cylindrical mass of filter tow material, the cylindrical mass comprising a substantially cylindrical first segment of filter tow material, and a substantially cylindrical second segment of filter tow material axially aligned with and connected to said first segment for rotation relative to the first segment about the longitudinal axis of the filter tow material, the filter tow material of said first segment being in direct contact with the filter tow material of said second segment.

18. The filter plug of claim 17 wherein the first segment and the second segment are defined by a circumferentially extending cut perpendicular to the longitudinal axis of the filter tow material.

19. A filter plug for use in the formation of a filter cigarette, comprising a substantially cylindrical mass of filter tow material, the cylindrical mass comprising a substantially cylindrical first segment of filter tow material, and a substantially cylindrical second segment of filter tow material, said first and second segments being defined by a circumferentially extending cut perpendicular to the longitudinal axis of the filter tow material wherein the cut defines a central axis core of filter tow material connecting the first segment to the second segment, said second segment being axially aligned with and connected to said first segment for rotation relative to the first segment about the longitudinal axis of the filter tow material, said first and second segments of filter tow material being in direct contact with each other.

20. The filter plug of claim 17 including an axial plastic extrusion connecting the first and second segments, said extrusion extending into each of said segments.

21. A filter plug for use in the formation of a filter cigarette, comprising a substantially cylindrical mass of filter tow material including an inner subtantially cylindrical core of filter tow material and an outer substantially cylindrical layer of filter tow material circumscribing the inner filter tow material, wherein the density of the inner filter tow material is greater than the density of the outer filer tow material, the cylindrical mass comprising a substantially cylindrical first segment and a substantially cylindrical second segment, said first segment and said second segment being defined by a circumferentially extending cut perpendicular to the longitudinal axis of the filter tow material, the cut extending to the inner filter tow material, said second segment being axially aligned with and connected to said first segment such that the second segment is rotatable relative to the first segment about the inner core and about the longitudinal axis of the filter tow material, said first and second segments of filter tow material being in direct contact with each other.

22. The filter plug of claim 17 wherein each of the segments has a longitudinally extending passage therethrough, disposed such that relative rotation of the first and second segments varies the degree of registry of the passages.

23. The filter plug of claim 17 including flavor encapsulation means for releasing a variable amount of flavorant responsive to rotation of the first segment.

24. The filter plug of claim 23 wherein the means comprises a plurality of axially disposed cells of flavorant which are ruptured in increasing number responsive to increasing rotation of the first segment.

25. The filter cigarette of claim 1 wherein said plug wrapping and said tipping paper are substantially air-impermeable.

26. The filter cigarette of claim 1 wherein said plug wrapping is air-permeable and said tipping paper is substantially air-impermeable.

27. The filter cigarette of claim 1 wherein said plug wrapping is substantially air-impermeable and said tipping paper is air-permeable.

* * * * *

UNITED STATES PATENT AND TRADEMARK OFFICE

CERTIFICATE OF CORRECTION

PATENT NO. : 4,532,943

DATED : August 6, 1985

INVENTOR(S) : Walter Allen Nichols et al.

It is certified that error appears in the above-identified patent and that said Letters Patent is hereby corrected as shown below:

Claim 16, line 2, "of one" should be --one of--.

Claim 21, line 8, "filer" should be --filter--.

Signed and Sealed this

Thirty-first Day of March, 1987

*Attest:*

DONALD J. QUIGG

*Attesting Officer*

*Commissioner of Patents and Trademarks*